US007954795B2

(12) United States Patent
Oshiro

(10) Patent No.: US 7,954,795 B2
(45) Date of Patent: Jun. 7, 2011

(54) POST-PROCESSING APPARATUS FOR PROCESSING PAPER SHEETS ON WHICH IMAGES ARE FORMED AND POST-PROCESSING METHOD

(75) Inventor: Toshiaki Oshiro, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 414 days.

(21) Appl. No.: 12/056,012

(22) Filed: Mar. 26, 2008

(65) Prior Publication Data

US 2009/0026686 A1 Jan. 29, 2009

Related U.S. Application Data

(60) Provisional application No. 60/952,348, filed on Jul. 27, 2007.

(51) Int. Cl.
*B65H 37/04* (2006.01)

(52) U.S. Cl. ..... 270/37; 270/20.1; 270/32; 270/45; 270/58.07; 270/58.08; 270/58.11; 270/58.12; 270/58.17

(58) Field of Classification Search ..... 270/20.1, 270/32, 37, 45, 51, 58.07, 58.08, 58.11, 58.12, 270/58.17, 58.27

See application file for complete search history.

(56) References Cited

U.S. PATENT DOCUMENTS

| | | | | |
|---|---|---|---|---|
| 6,712,349 | B2 * | 3/2004 | Watanabe | 270/37 |
| 2003/0168796 | A1 * | 9/2003 | Suzuki et al. | 270/58.07 |
| 2004/0126163 | A1 * | 7/2004 | Asami et al. | 399/410 |
| 2004/0170462 | A1 * | 9/2004 | Awano | 400/621 |
| 2006/0017218 | A1 * | 1/2006 | Kawata et al. | 271/207 |
| 2006/0153612 | A1 * | 7/2006 | Saitsu et al. | 399/410 |

FOREIGN PATENT DOCUMENTS

| | | |
|---|---|---|
| JP | 11-193175 | 7/1999 |
| JP | 2004-145200 | 5/2004 |
| JP | 2004-195569 | 7/2004 |
| JP | 2005-022175 | 1/2005 |

* cited by examiner

*Primary Examiner* — Leslie A Nicholson, III
(74) *Attorney, Agent, or Firm* — Patterson & Sheridan, LLP

(57) ABSTRACT

A post-processing unit of an image forming apparatus includes a vertical conveying path and a horizontal conveying path. A stapling mechanism and a folding mechanism are arranged in the horizontal conveying path. When saddle processing is carried out, paper sheets sent into the horizontal conveying path are struck against a trailing end stopper and, after the number of sheets to be bound is accumulated, the center of the paper sheets is stapled and folded double. A movable tray projected to the outside of a housing is provided at a terminal end of the horizontal conveying path. The movable tray functions as a tray for discharging paper sheets that pass through a saddle stitcher and also functions as a supporting member that supports a leading end side of the paper sheets at the time of the saddle processing.

5 Claims, 5 Drawing Sheets

POST-PROCESSING APPARATUS FOR PROCESSING PAPER SHEETS ON WHICH IMAGES ARE FORMED AND POST-PROCESSING METHOD

CROSS-REFERENCE TO RELATED APPLICATIONS

This application claims the benefit of U.S. Provisional Application No. 60/952,348, filed Jul. 27, 2007.

BACKGROUND OF THE INVENTION

1. Field of the Invention

The present invention relates to a post-processing apparatus and a post-processing method for processing paper sheets on which images are formed by an image forming apparatus such as a copying machine, and, more particularly to a post-processing apparatus and a post-processing method having a bookbinding function for stapling and folding paper sheets having images formed thereon.

2. Description of the Related Art

There has been known a sheet processing apparatus disclosed in JP-A-11-193175 as a post-processing apparatus having a bookbinding function for stapling and folding plural paper sheets having images formed thereon. The sheet processing apparatus operates to staple and fold double a bundle of plural sheets on which images are formed by an image forming apparatus.

Specifically, sheets sent into the sheet processing apparatus are sent into a conveying path extending downward substantially vertically, struck against a stopper near a lower end of the conveying path, and aligned at leading ends thereof. Plural sheets with leading ends thereof aligned are stapled by a stapling unit arranged in the middle of the conveying path and folded double by a sheet bundle folding apparatus.

The sheet bundle folding apparatus includes two folding rollers arranged on one side of the conveying path extending downward substantially vertically and a projecting unit arranged to be opposed to a nip of the rollers at the other side of the conveying path. A sheet bundle folded double by the sheet bundle folding apparatus directly passes through between the two folding rollers and is discharged onto a stacking tray arranged on the outside of a housing of the sheet processing apparatus.

The sheet processing apparatus disclosed in JP-A-11-193175 includes a stacker tray on an outer side of the housing besides the stacking tray. The stacker tray functions as a tray for causing sheets sent therein from the image forming apparatus to directly pass and discharges the sheets when a stack mode is selected. The stacking tray functions as a tray for, as described above, bookbinding and discharging sheets sent therein from the image forming apparatus when a bookbinding mode is selected.

In the apparatus disclosed in JP-A-11-193175, it is necessary to separately provide the stacker tray for discharging sheets not bound and the stacking tray for discharging a bound sheet bundle. Therefore, the structure of the apparatus is complicated, the number of components increases, manufacturing cost for the apparatus increases, and a size of the apparatus increases.

BRIEF SUMMARY OF THE INVENTION

It is an object of the present invention to provide a post-processing apparatus for processing paper sheets and a post-processing method that can simplify the structure of the apparatus, reduce the number of components, and reduce manufacturing cost for the apparatus.

In order to attain the object, a post-processing apparatus according to an embodiment of the present invention includes an accumulating unit that vertically stacks and accumulates plural paper sheets, a conveying unit that conveys the plural paper sheets accumulated in the accumulating unit through a conveying path extending in a lateral direction, an aligning unit that aligns trailing ends in a conveying direction of the plural paper sheets accumulated in the accumulating unit, a stapling unit that staples the plural paper sheets with the trailing ends thereof aligned by the aligning unit and conveyed to a stapling position through the conveying path, a folding unit that folds the plural paper sheets stapled by the stapling unit and conveyed to a folding position through the conveying path, and a supporting member that supports a leading end side in the conveying direction of the plural paper sheets on a downstream side of the folding unit along the conveying direction.

According to the present invention, it is possible to discharge, using the supporting member that supports a leading end side in a conveying direction plural paper sheets conveyed through the conveying path, one paper sheet not bound, plural paper sheets not bound with trailing ends thereof simply aligned, plural paper sheets not folded and simply bound, or the like. It is possible to use the supporting member for discharging paper sheets as a discharge tray as well. Therefore, it is possible to simplify the structure of the apparatus, reduce the number of components, and reduce manufacturing cost for the apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments give below, serve to explain the principles of the invention.

DETAILED DESCRIPTION OF THE INVENTION

An embodiment of the present invention will be hereinafter explained in detail with reference to the accompanying drawings.

Figure 1:
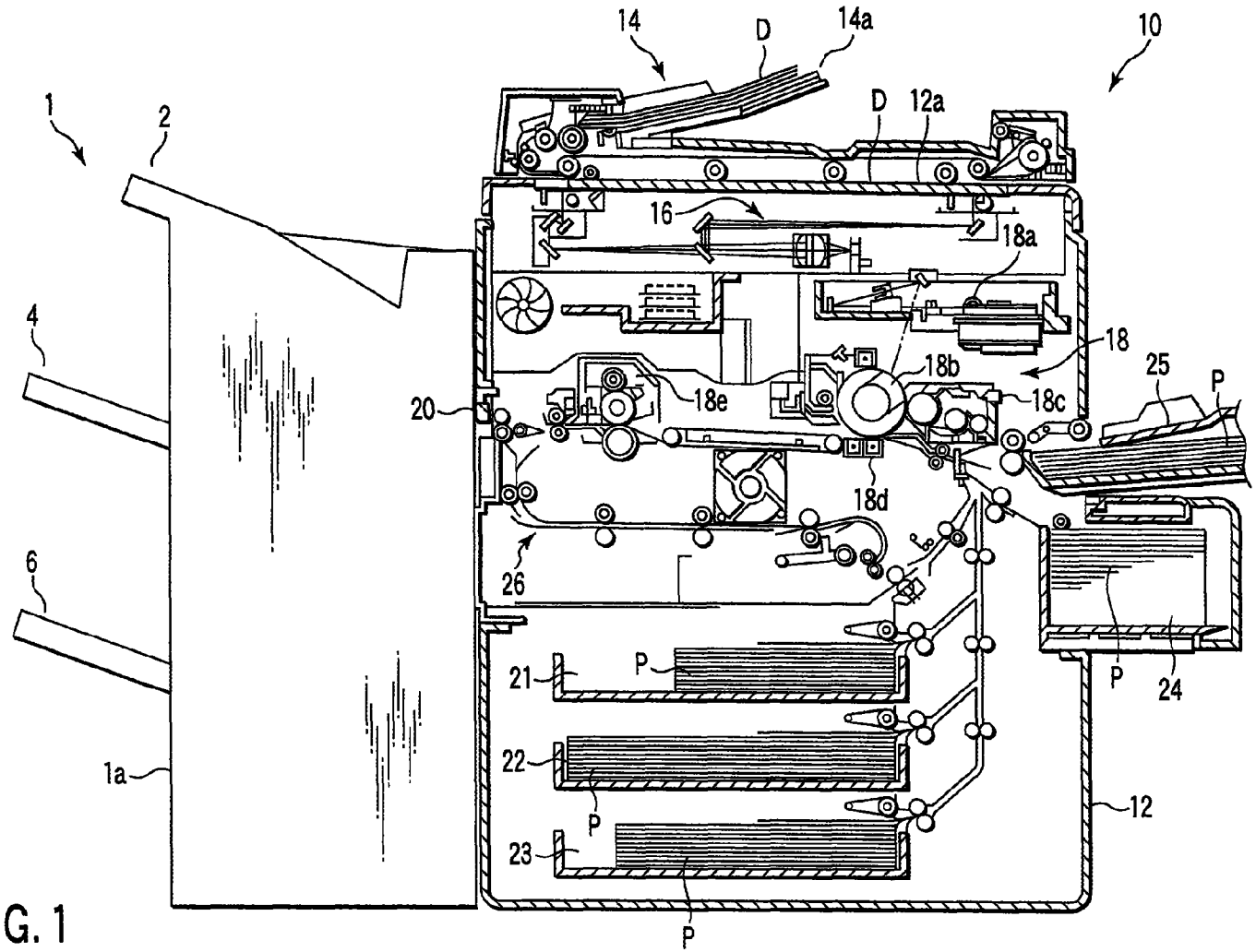
FIG. 1 is a schematic diagram showing an image forming apparatus to which a post-processing unit including a saddle stitcher according to an embodiment of the present invention is connected.

FIG. 1 is a schematic diagram of an image forming apparatus 10 to which a post-processing unit 1 functioning as a post-processing apparatus according to the embodiment of the present invention is connected. In FIG. 1, the illustration of the post-processing unit 1 is simplified. In particular, the illustration of the internal structure thereof is omitted.

The image forming apparatus 10 has a housing 12 forming an outer shell of the apparatus and has an original placing stand 12*a* made of a transparent glass plate on an upper surface of the housing 12. An automatic document feeder 14 (hereinafter simply referred to as ADF 14) is provided on the original placing stand 12*a* to be capable of opening and closing. The ADF 14 operates to automatically feed originals D to a predetermined position on the original placing stand 12*a*.

For example, a user sets the originals D on a paper feeding tray 14*a* of the ADF 14 and, after setting the number of copies, a sheet size, presence or absence of bookbinding processing, the number of copies to be bound, and the like, presses a copy start switch. Then, the originals D on the paper feeding tray 14*a* are automatically fed to an original scanning position on the original placing stand 12*a* one by one. After original scanning, the originals D are automatically discharged at appropriate timing.

A scanner unit 16, a printer unit 18, cassettes 21, 22, and 23 for copy sheets P, and the like are disposed in the housing 12. A large capacity feeder 24 in which a large volume of sheets of the same size are stored and a manual feeding tray 25 are attached to a right wall in the figure of the housing 12. The post-processing unit 1 described in detail later is connected to a left wall in the figure of the housing 12.

The scanner unit 16 illuminates and scans the originals D fed to the original scanning position on the original placing stand 12*a* by the ADF 14, scans reflected light of the originals D and photoelectrically converts the reflected light, and acquires image information of the originals D.

The printer unit 18 urges a laser device 18*a* on the basis of the image information scanned by the scanner unit 16 and forms an electrostatic latent image based on the image information on a peripheral surface of a photoconductive drum 18*b*. The printer unit 18 supplies a toner to the electrostatic latent image on the photoconductive drum 18*b* via a developing device 18*c* and visualizes the electrostatic latent image. The printer unit 18 transfers a toner image of the electrostatic latent image to the copy sheets P using a transfer charger 18*d*. At this point, the copy sheets P are fed from the cassettes 21, 22, and 23, the large capacity feeder 24, or the manual feeding tray 25.

The printer unit 18 feeds the copy sheets P having the toner image transferred thereon to the fixing device 18*e*, heats and melts the toner image to fix the toner image on the copy sheets P, and discharges the copy sheets P to the post-processing unit 1 through a discharge portion 20. The copy sheets P discharged through the discharge port 20 correspond to paper sheets M of the present invention.

After passing through the fixing device 18*e*, the copy sheets P for which duplex copying is necessary are conveyed to a reversal conveying path 26 and reversed and sent into a fixing area between the photoconductive drum 18*b* and the fixing device 18*e* again.

Figure 2:
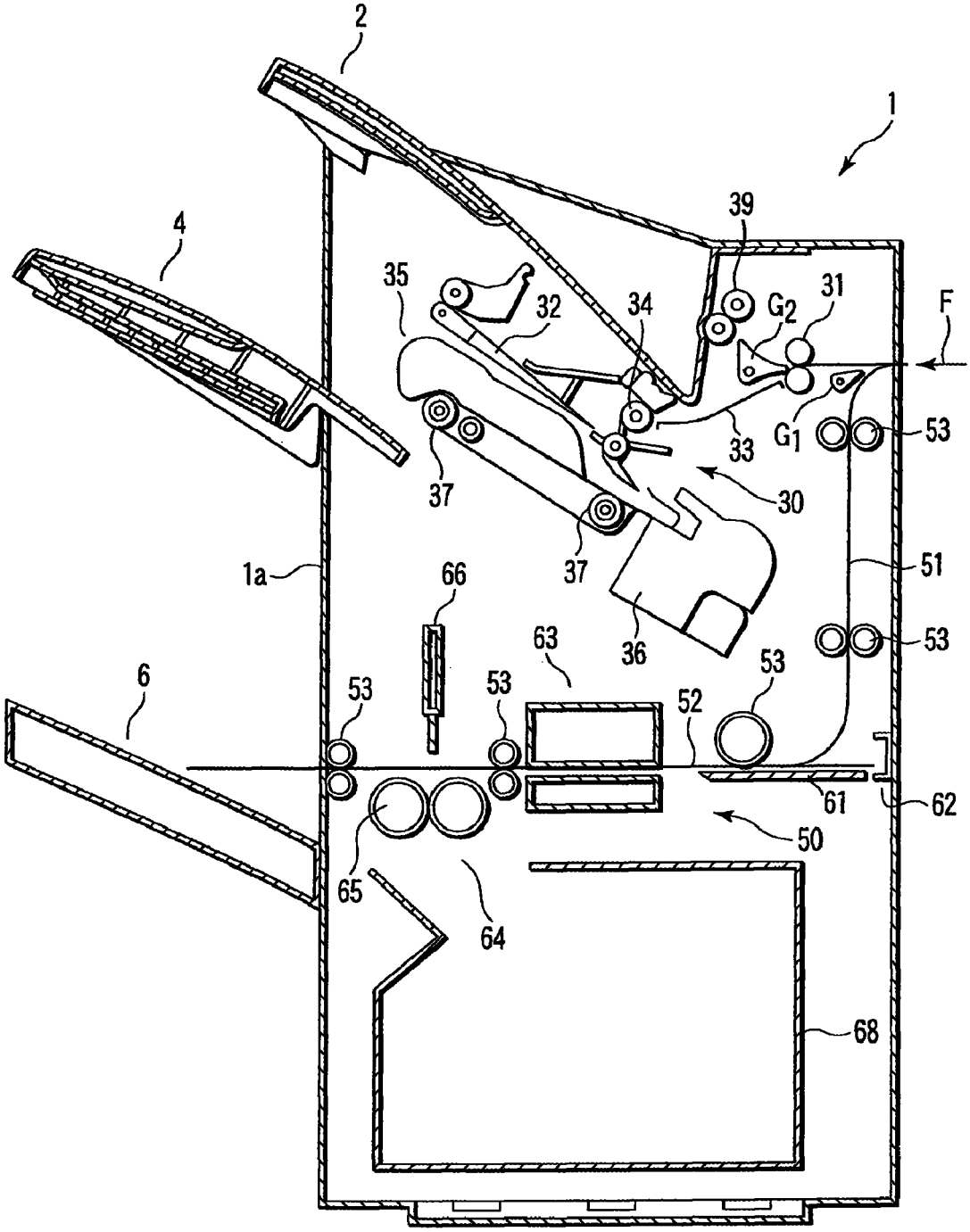
FIG. 2 is a schematic diagram showing the internal structure of the post-processing unit shown in FIG. 1.

The schematic structure of the post-processing unit 1 is shown in FIG. 2.

The post-processing unit 1 includes a finisher 30 (another processing unit) that operates to accumulate and align, in units of number of copies (units of the number of sheets collectively stapled), the copy sheets P having images formed on one side or both sides thereof, i.e., the paper sheets M discharged through the discharge port 20 of the image forming apparatus 10 and subjects the copy sheets P to staple processing. The staple processing refers to processing for aligning one end of accumulated plural paper sheets M and stapling the paper sheets M. The finisher 30 also operates in a sort mode for simply sorting and discharging, in units of number of copies, the paper sheets M having images formed thereon.

A saddle stitcher 50 for accumulating and stapling the plural paper sheets M having images formed thereon and folding double and binding the paper sheets M is provided below the finisher 30 in the housing 1*a* of the post-processing unit 1.

An upper stage tray 2 for discharging the paper sheets M sent from the image forming apparatus 10 while keeping a state of the sent paper sheets is provided on an upper surface of the housing 1*a* of the post-processing unit 1. On a left wall in the figure of the housing 1*a* of the post-processing unit 1 apart from the image forming apparatus 10, a movable tray 4 for discharging plural paper sheets M sorted or stapled through the finisher 30 are provided to be projected in the lateral direction from the housing 1*a*. On a left wall of the housing 1*a* apart from the movable tray 4 downward, a lower stage movable tray 6 (a discharge tray) for discharging the paper sheets M (one or plural) processed through the saddle stitcher 50 is provided to be projected in the lateral direction from the housing 1*a*.

As shown in FIG. 2, the finisher 30 includes inlet rollers 31 that receives, in a nip thereof, the paper sheets M sent in an arrow F direction in the figure through the discharge port 20 (FIG. 1) of the image forming apparatus 10 and rotates. Between the inlet roller 31 and a right wall of the housing 1*a*, a gate G1 for selectively allocating the paper sheets M sent in the arrow F direction to the finisher 30 or the saddle stitcher 50 is provided.

A gate G2 for further selectively allocating a conveying destination of the paper sheets M in two directions is provided downstream the inlet roller 31. The upper stage tray 2 is provided ahead of a conveying path branched to obliquely upper left in the figure through the gate G2. The paper sheets M directed to obliquely upper left through the gate G2 passes through a nip of discharge rollers 39 and is discharged onto the upper stage tray 2.

A standby tray 32 for accumulating the plural paper sheets M and putting the paper sheets M on standby is provided ahead of the conveying path branched obliquely left downward in the figure through the gate G2. A guide member 33 for guiding the paper sheets M to a nip of outlet rollers 34 is provided between the gate G2 and the standby tray 32. The paper sheets M conveyed obliquely left downward through the gate G2 are guided along the guide member 33, received by the nip of the outlet rollers 34, and accumulated in the standby tray 32 in order.

A processing tray 35 for receiving the paper sheets M dropped from the standby tray 32 and aligning trailing ends thereof for the staple processing is provided below the standby tray 32. A stapler 36 that subjects the trailing ends of the paper sheets M accumulated and aligned in the processing tray 35 to the staple processing is provided on an obliquely right lower side of processing tray 35 in the figure. The standby tray 32 and the processing tray 35 are provided to be inclined obliquely right downward in the figure to a rear end in a sending direction of the paper sheets M.

Fixed processing time is required for the staple processing by the stapler 36. Therefore, when certain paper sheets M in the processing tray 35 are subjected to the staple processing, it is necessary to put paper sheets M in the next unit of number of copies on standby in a place separate from the processing tray 35. In this embodiment, when paper sheets M in the previous unit of number of copies are subjected to the staple processing, first two paper sheets M among paper sheets M in the next unit of number of copies are put on standby in the standby tray 32 to secure time for subjecting the paper sheets M in the previous unit of number of copies to the staple processing.

In other words, a first paper sheet M and a second paper sheet M conveyed through the gate G2 are accumulated in the standby tray 32 and, after the staple processing for the paper sheets M in the previous unit of number of copies is finished, two paper sheets M put on standby are dropped to the processing tray 35, and third and subsequent paper sheets M are accumulated in the processing tray 35 one by one through the standby tray 32.

A bundle of the plural paper sheets M accumulated and stapled at the trailing ends thereof by the finisher 30 is conveyed obliquely right upward by plural conveying rollers 37 arranged on a lower surface side of the processing tray 35 and is discharged to the movable tray 4. In some case, the plural paper sheets M with the trailing ends thereof aligned by the finisher 30 are discharged to the movable tray 4 without being stapled.

On the other hand, the saddle stitcher 50 arranged below the finisher 30 includes a vertical conveying path 51 for conveying, vertically downward, the paper sheets M sent in the arrow F direction through the gate G1 and a horizontal conveying path 52 continuing from the vertical conveying path 51. The vertical conveying path 51 extends through the right side in the figure of the finisher 30. The horizontal conveying path 52 extends over substantially the entire width of the housing 1*a*. Moreover, plural conveying rollers 53 (conveying units) are provided in the conveying paths 51 and 52.

In this embodiment, the horizontal conveying path 52 is extended in a substantially horizontal direction. However, the horizontal conveying path 52 may be slightly inclined to upper left in the figure. In the following explanation, a direction from the gate G1 to the left side in the figure on the horizontal conveying path 52 through the vertical conveying path 51 is set as a conveying forward direction. A leading end and a trailing end of the paper sheet M are defined along the conveying direction. The lower stage movable tray 6 is allocated to the saddle stitcher 50.

Figure 5:
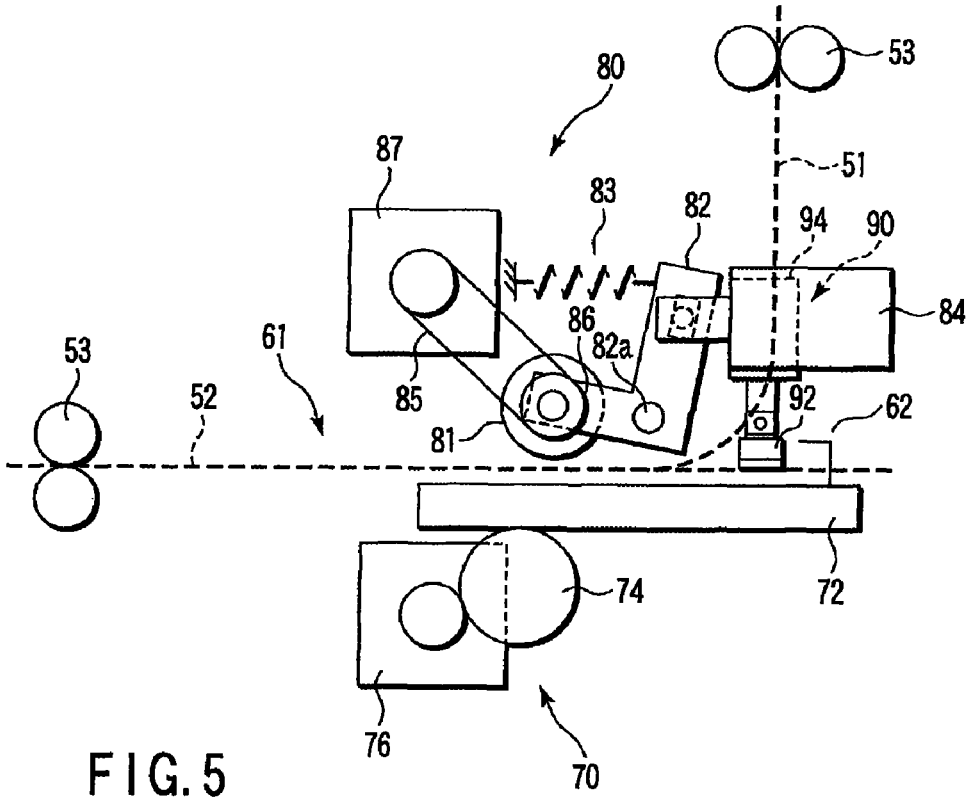
FIG. 5 is a schematic diagram of a main part of the saddle stitcher shown in FIG. 2.

The saddle stitcher 50 includes an accumulating unit 61 that vertically stacks and accumulates the paper sheets M sent to the horizontal conveying path 52 through the vertical conveying path 51. A trailing end stopper 62 (an aligning unit) that aligns trailing ends in a conveying direction of accumulated plural paper sheets M is provided behind (on the right in the figure) of the accumulating unit 61, i.e., on an upstream side in the conveying direction. The trailing end stopper 62 is moved along the horizontal conveying path 52 by a moving mechanism 70 described later (FIG. 5).

On a downstream side in the conveying direction (on the left in the figure), a stapler 63 (a stapling unit) that staples the accumulated plural paper sheets M with staples and a saddle mechanism 64 (a folding unit) that folds double a bundle of the plural stapled paper sheets M are provided in order along the conveying direction. The plural paper sheets M with the trailing ends thereof aligned by the trailing end stopper 62 are conveyed to a stapling position for performing the staple processing and a folding position for performing saddle processing when the trailing end stopper 62 is moved in the conveying direction.

The stapler 63 usually staples the bundle of the plural paper sheets M with staples along a center line in the center along the conveying direction. However, the stapler 63 can also staple the plural paper sheets M, for example, near the trailing ends aligned by the trailing end stopper 62. When the paper sheets M are conveyed along a longitudinal direction of the horizontal conveying path 52 and accumulated in the accumulating unit 61, by stapling the trailing ends of the paper sheets M, it is possible to form a booklet stapled at one end in a longitudinal direction of the paper sheets M.

The saddle mechanism 64 provided on a downstream side in the conveying direction of the stapler 63 includes a pair of folding rollers 65 (a roller pair) arranged adjacent to a lower side of the horizontal conveying path 52 and a folding blade 66 above and opposed to a nip of the pair of folding rollers 65 across the horizontal conveying path 52. The pair of folding rollers 65 are arranged in a posture in which a nip between the rollers extends in a direction orthogonal to the conveying direction of the paper sheets M. The folding blade 66 is driven vertically downward by a not-shown driving mechanism and arranged in a posture pushed into the nip of the folding rollers 65.

The center in the conveying direction of the plural paper sheets M conveyed to the folding position through the horizontal conveying path 52 by the movement of the trailing end stopper 62 is pushed downward by the folding blade 66. The folding blade 66 is directly pushed downward through the nip of the folding rollers 65. Consequently, the plural paper sheets M are folded double and dropped to a storage box 68 (a receiving unit) put on standby below the nip. After folding double the plural paper sheets M and storing the paper sheets M in the storage box 68 in this way, the folding blade 66 is returned to a home position shown in the figure apart upward from the horizontal conveying path 52.

Figure 3:
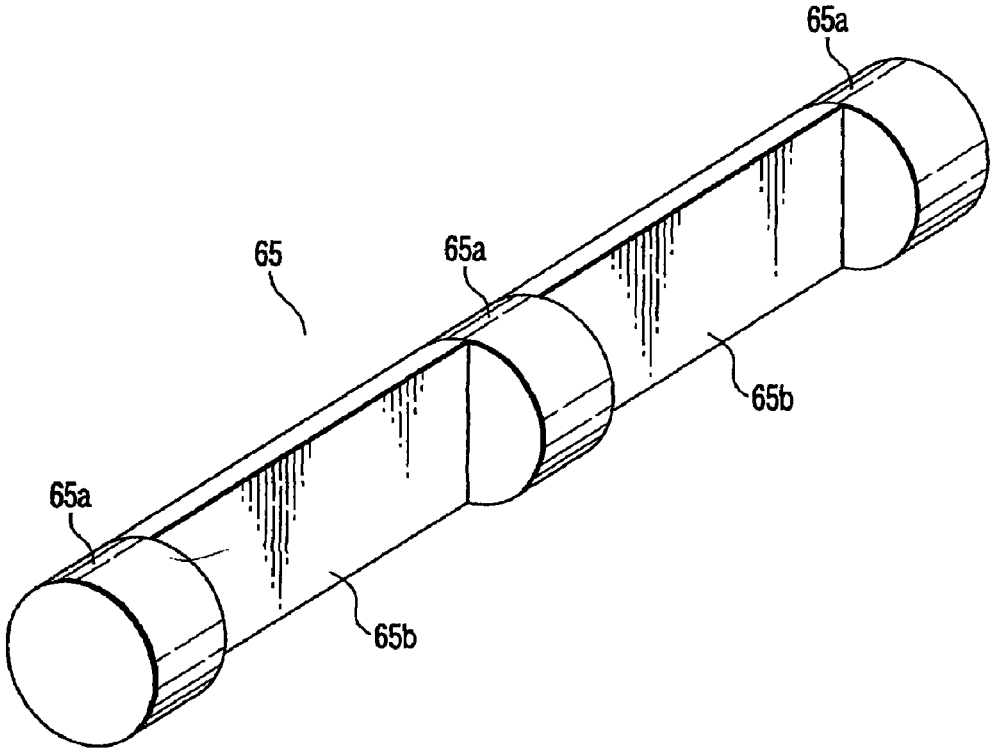
FIG. 3 is an external perspective view showing a folding roller of the saddle stitcher shown in FIG. 2.
Figure 4:
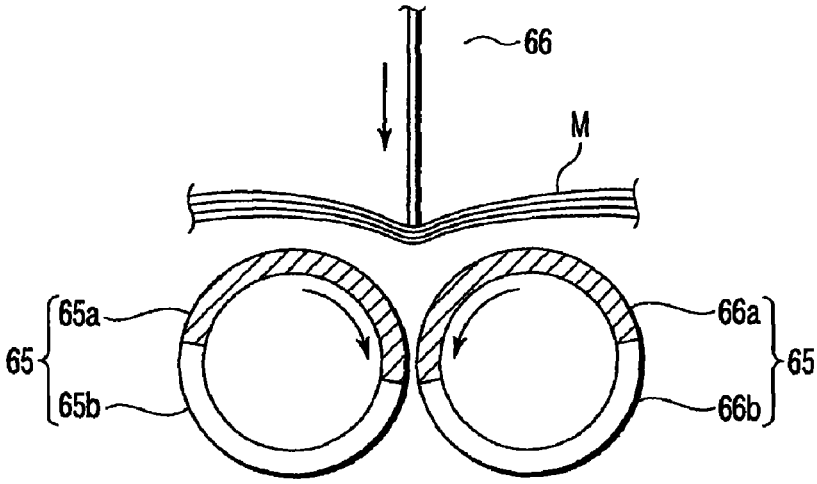
FIG. 4 is a sectional view of the folding roller shown in FIG. 3.

FIG. 3 is a perspective view of an external perspective view of the folding roller 65. To facilitate understanding of explanation, only one folding roller 65 is shown. FIG. 4 is a sectional view of the pair of folding rollers 65.

The folding roller 65 includes a semi-cylindrical section 65*b* formed by coupling three roller sections 65*a* apart in an axial direction and respective inter-roller sections. The three roller sections 65*a* function to always nip and restrain the plural paper sheets M sent to the nip between the rollers and folded double and send the paper sheets M to the storage box 68 below. The semi-cylindrical section 65*b* has a peripheral surface for a half periphery continuing to peripheral surfaces of the roller sections 65*a*. As shown in FIG. 4, the peripheral surfaces are rotated in arrow directions in the figure to rotate in synchronization with and opposed to each other.

When the plural paper sheets M stapled and conveyed to the folding position are folded double, as shown in FIG. 4, a tip of the folding blade 66 is brought into contact with a stapling position of the plural paper sheets M, the folding blade 66 is moved in an arrow direction in the figure (downward), the pair of folding rollers 65 are rotated in the arrow directions in the figure, and the plural paper sheets M are pushed into the nip between the rollers. At this point, to form a nip between the peripheral surfaces of the semi-cylindrical sections 65*b* of the folding roller 65, the pair of folding rollers 65 are rotated such that the peripheral surface of the semi-cylindrical sections 65*b* reach the nip at timing when the tip of the folding blade 66 reaches the nip. The folding blade 66 is further moved downward and the folding rollers 65 are further rotated to drop the plural paper sheets M folded double to the storage box 68.

In this way, by forming the most part of the folding rollers 65 in the semi-cylindrical shape rather than a columnar shape, it is possible to form the nip continuing over the entire length of the roller 65 only in a portion where it is desired to form a fold, set a binding force given to the paper sheets M as small as possible in rotating positions other than the portion, and reduce a mechanical load.

The structure of a main part of the saddle stitcher 50 and an operation thereof are explained below with reference to FIGS. 5 to 7.

First, the structure of the main part is explained.

The moving mechanism 70 that moves the trailing end stopper 62 along the horizontal conveying path 52 includes a rack 72 extended along the horizontal conveying path 52, a pinion 74 that meshes with the rack 72, and a motor 76 for rotating the pinion 74 in both normal and reverse directions. When the motor 76 is rotated, the pinion 74 rotates and the rack 72 meshing with the pinion 74 moves in a left to right and a right to left direction in the figure along the horizontal conveying path 52. Consequently, the trailing end stopper 62 fixed to the rack 72 moves along the horizontal conveying path 52.

An aligning mechanism 80 is provided above the accumulating unit 61. The aligning mechanism 80 functions to strike the trailing ends of the paper sheets M sent into the accumulating unit 61 against the trailing end stopper 62 and align the trailing ends.

The aligning mechanism 80 includes an aligning roller 81 that rotates in contact with the paper sheet M at an uppermost end accumulated in the accumulating unit 61, an arm 82 of an L shape, to a distal end of which the aligning roller 81 is rotatably attached, a solenoid 84 for urging a rear end of the arm 82 against an urging force of a tension sprig 83 and rotating the arm around a rotation axis 82*a* to separate the aligning roller 81 upward from the paper sheet M, and a motor 87 coupled to a pulley 86 of the aligning roller 81 via an endless belt 85.

A pressing mechanism 90 that presses a portion near the trailing end of the paper sheets M with the trailing ends thereof aligned by the trailing end stopper 62 is provided behind the accumulating unit 61. The pressing mechanism 90 includes a trailing end clamper 92 that presses the trailing ends of the paper sheets M from above and a solenoid 94 for separating the trailing end clamper 92 from and bringing the trailing end clamper 92 into contact with the paper sheets M. The pressing mechanism 90 functions to press the trailing ends of the accumulated paper sheets M in order to prevent the accumulated paper sheets M from shifting to a distal end side by collision of the paper sheets M to be sent next.

An operation of the main part of the saddle stitcher 50 is explained.

A posture of the paper sheets M sent into the saddle stitcher 50 through the vertical conveying path 51 is changed to a substantially horizontal posture according to the guide of a not-shown conveyance guide. The paper sheets M are guided to the horizontal conveying path 52 and accumulated in the accumulating unit 61. The paper sheets M are conveyed through the respective conveying paths 51 and 52 by the plural conveying rollers 53. In this case, as shown in FIG. 5, the solenoid 84 of the aligning mechanism 80 is turned on and the aligning roller 81 is retracted to a retraction position separated above the accumulating unit 61.

A first paper sheet M is accumulated in the accumulating unit 61 in a state in which the aligning roller 81 is retracted. Then, as shown in FIG. 6, the solenoid 84 of the aligning mechanism 80 is turned off and the aligning roller 81 is lowered to the first paper sheet M. At the same time, the solenoid 94 of the pressing mechanism 90 is turned on and the trailing end clamper 92 is retracted upward.

The motor 87 is urged and the aligning roller 81 is rotated in a counterclockwise direction in the figure from this state. The first paper sheet M accumulated in the accumulating unit 61 is conveyed to the trailing end side. Consequently, the trailing end of the paper sheet M is struck against the trailing end stopper 62 and aligned. After the trailing end of the first paper sheet M is aligned in this way, the motor 87 is stopped and the rotation of the aligning roller 81 is stopped.

Figure 6:
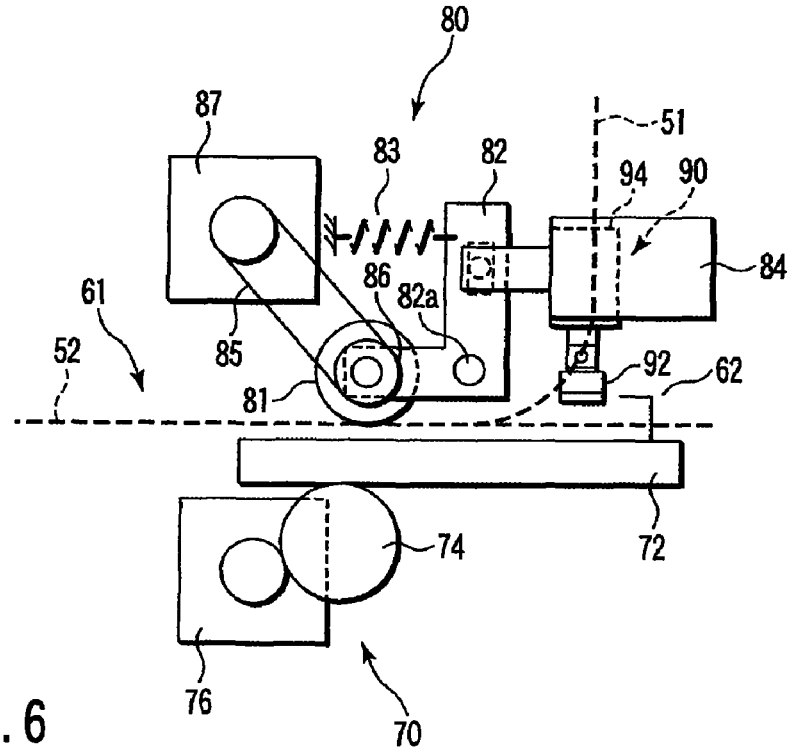
FIG. 6 is a schematic diagram for explaining an operation of the main part of the saddle stitcher in conjunction with FIG. 5.
Figure 7:
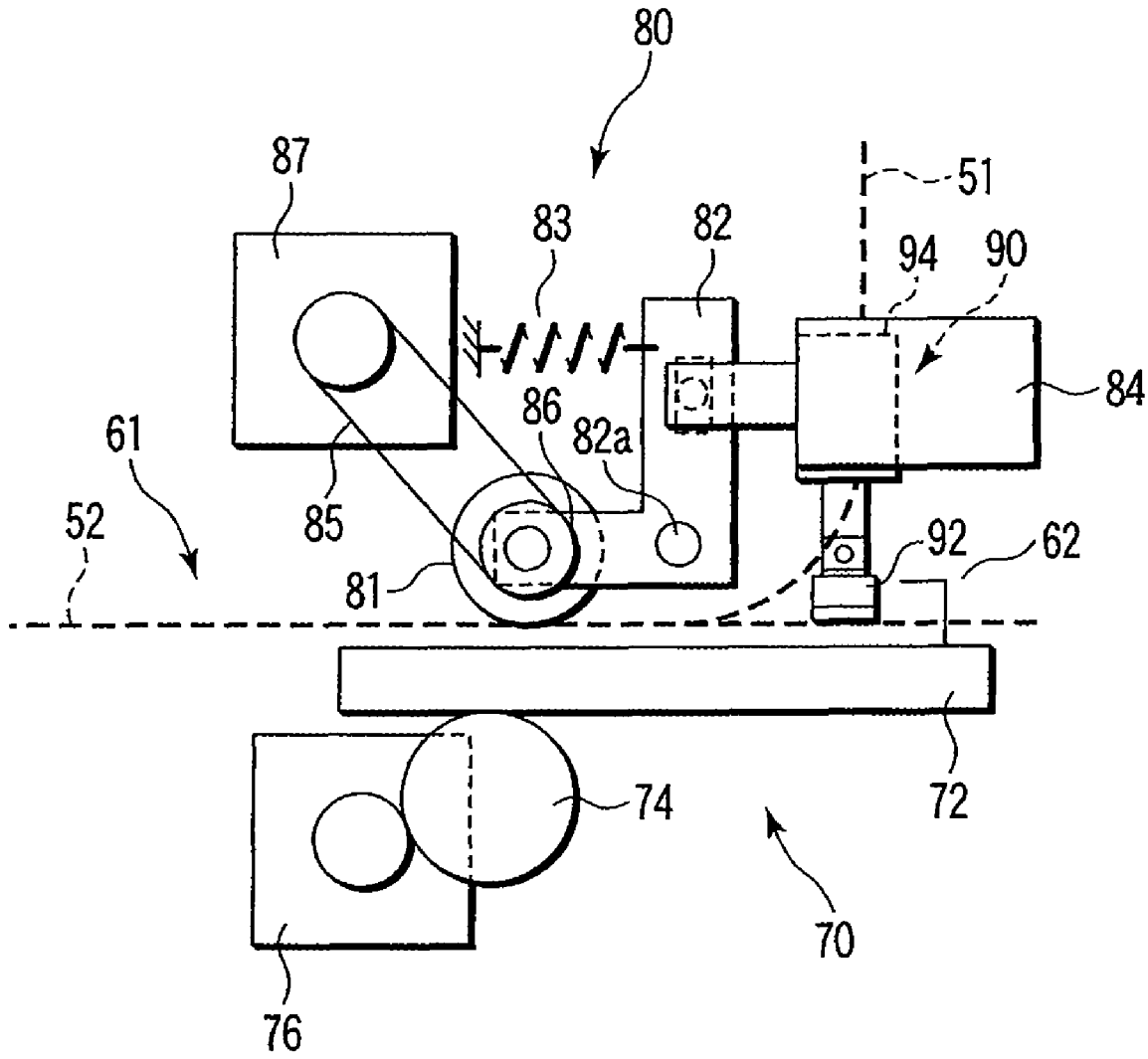
FIG. 7 is a schematic diagram for explaining an operation of the main part of the saddle stitcher in conjunction with FIGS. 5 and 6.

A portion near the trailing end of the first paper sheet M, the trailing end of which is struck against the trailing end stopper 62, is restrained by the pressing mechanism 90 in a state shown in FIG. 6, i.e., a state in which the aligning roller 81 is in contact with the first paper sheet M. At this point, the solenoid 94 of the pressing mechanism 90 is turned off and the trailing end clamper 92 is lowered to press the trailing end of the first paper sheet M from above. This state is shown in FIG. 7.

Thereafter, as shown in FIG. 5, the aligning roller 81 is retracted upward and put on standby for accumulation of second paper sheet M. By accumulating the second paper sheet M in the state in which the trailing end of the first paper sheet M is pressed in this way, it is possible to prevent an accumulation posture of the first paper sheet M from being shifted by the collision of the second paper sheet M.

After the series of operation described above is repeated for the number of sheets to be bound, the restraint by the trailing end clamper 92 is released, the trailing end stopper 62 is moved to the leading end side by the moving mechanism 70, the plural paper sheets M with the trailing ends thereof aligned are conveyed to the stapling position and the folding position in order, and the staple processing and the saddle processing are carried out in order.

When the saddle processing is carried out, the leading end side of the stapled plural paper sheets M is projected to the outside of the housing 1*a*. In this case, the leading end projected to the outside of the housing 1*a* is supported by the lower stage movable tray 6 also functioning as the supporting member of the present invention. Consequently, it is possible to prevent the leading end side of the paper sheets M from hanging down to the outside of the housing 1*a* to cause folding and bending of the paper sheets M and contribute to a reduction in size of the apparatus.

Besides functioning as the supporting member that supports the leading end side of the paper sheets M at the time of the saddle processing as described above, the lower stage movable tray 6 also functions as a discharge tray that discharges one paper sheet M not bound, plural paper sheets M not bound with trailing ends thereof simply aligned, or plural paper sheets M not folded and simply stapled. The lower stage movable tray 6 is movable upward and downward in accordance with the number of sheets to be accumulated.

For example, the paper sheets M sent into the saddle stitcher 50 can be directly discharged to the lower stage movable tray 6 through the vertical conveying path 51 and the horizontal conveying path 52. When the plural paper sheets M with the trailing ends thereof aligned are directly discharged to the lower stage movable tray 6, after the series of operation explained with reference to FIGS. 5 to 7 is carried out, the trailing end stopper 62 only has to be moved to the leading end side and the plural conveying rollers 53 only have to be rotated. Moreover, the paper sheets M with the trailing ends thereof aligned may be discharged after being subjected to the staple processing.

As described above, according to this embodiment, it is possible to cause the lower stage movable tray 6 for discharging the paper sheets M passed through the saddle stitcher 50 to function as the supporting member at the time of the saddle processing, use one tray as another tray as well, simplify the structure of the apparatus, reduce the number of components, and reduce manufacturing cost for the apparatus.

In particular, by providing the three discharge trays 2, 4, and 6 in the post-processing unit 1 as in this embodiment, for example, it is also possible to allocate the respective trays 2, 4, and 6 individually as trays for a printer, a copying machine, and a facsimile, respectively. By providing the lower stage movable tray 6 at a terminal end of the horizontal conveying path 52 passing through the saddle stitcher 50, it is possible to use a conveying route passing through the saddle stitcher 50 as a route for directly discharging sheets.

According to this embodiment, since the horizontal conveying path 52 passing through the saddle stitcher 50 in the substantially horizontal direction, it is possible to store the plural paper sheets M folded double by the saddle mechanism 64 in the housing 1*a*. In other words, it is possible to provide the storage box 68 below the horizontal conveying path 52. Consequently, compared with the apparatus in the past, it is possible to increase a space in which plural booklet-like paper sheets M after being subjected to the saddle processing are stored and increase the number of copies to be subjected to the saddle processing at a time.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

For example, in the embodiment described above, after the trailing ends of the paper sheets M accumulated in the accumulating unit 61 are aligned, the paper sheets M are conveyed to the stapling position. However, the present invention is not limited to this. The trailing end stopper 62 may be moved in advance according to a size of the paper sheets M to staple the paper sheets M in a position where the trailing ends thereof are aligned. In this case, a conveyance process after the trailing ends are aligned is unnecessary. Therefore, it is possible to reduce processing time.

What is claimed is:

1. A post-processing apparatus comprising:

an accumulating unit configured to accumulate plural paper sheets;

a conveying unit configured to convey the plural paper sheets accumulated in the accumulating unit through a conveying path extending in a lateral direction;

an aligning unit configured to align trailing ends in a conveying direction of the plural paper sheets accumulated in the accumulating unit;

a stapling unit configured to staple the plural paper sheets with the trailing ends thereof aligned by the aligning unit and conveyed to a stapling position through the conveying path;

a folding unit configured to fold the plural paper sheets stapled by the stapling unit and conveyed to a folding position through the conveying path, the folding unit including a roller pair that has a nip extending in a direction orthogonal to the conveying path below the conveying path and a folding blade that is arranged in a position opposed to the nip of the roller pair above the conveying path and driven downward to push the plural paper sheets, which are conveyed to the folding position between the folding blade and the nip, into the nip;

a housing that surrounds the accumulating unit, the conveying unit, the aligning unit, the stapling unit, and the folding unit, the housing unit having a receiving unit configured to receive the plural paper sheets that are pushed into the nip by the folding blade and pass through the nip; and a supporting member projecting outside of the housing and configured to support a leading end in the conveying direction of the plural paper sheets when folding the plural paper sheets at the folding unit.

2. A post-processing apparatus according to claim 1, further comprising another processing unit configured to process, in the housing, paper sheets other than paper sheets designated to be accumulated in the accumulating unit among paper sheets sent into the housing.

3. A post-processing method comprising:

accumulating plural paper sheets;

aligning trailing ends in a conveying direction of the accumulated plural paper sheets;

conveying the plural paper sheets with the trailing ends thereof aligned in the conveying direction through a conveying path extending in a surface direction of the paper sheets;

supporting, using a supporting member arranged at a terminal end of the conveying path and projecting outside of a housing, a leading end in the conveying direction of the plural paper sheets conveyed through the conveying path;

stapling the plural paper sheets conveyed to a stapling position;

folding, using a roller pair that has a nip extending in a direction orthogonal to the conveying path below the conveying path and a folding blade that is arranged in a position opposed to the nip of the roller pair above the conveying path, the plural paper sheets further conveyed to a folding position with the leading end thereof supported by the supporting member; and receiving the folded plural paper sheets that are pushed into the nip by the folding blade and pass through the nip, in a receiving unit of the housing.

4. A post-processing method according to claim 3, wherein the folded plural paper sheets are stored in a housing.

5. A post-processing method according to claim 4, wherein only one paper sheet conveyed through the conveying path, plural paper sheets in an accumulated state conveyed through the conveying path with the trailing ends thereof aligned, and plural paper sheets in an unfolded state conveyed to the stapling position, stapled, and conveyed through the conveying path, are discharged to the supporting member.

* * * * *